US010480222B2

(12) United States Patent
Funahashi et al.

(10) Patent No.: US 10,480,222 B2
(45) Date of Patent: Nov. 19, 2019

(54) DOOR LATCHING DEVICE AND MOVING BODY MOUNTED WITH SAME

(71) Applicant: Panasonic Intellectual Property Management Co., Ltd., Osaka (JP)

(72) Inventors: Osamu Funahashi, Osaka (JP); Hisao Hiragi, Saitama (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 1004 days.

(21) Appl. No.: 14/778,580

(22) PCT Filed: Mar. 12, 2014

(86) PCT No.: PCT/JP2014/001397
§ 371 (c)(1),
(2) Date: Sep. 19, 2015

(87) PCT Pub. No.: WO2014/156016
PCT Pub. Date: Oct. 2, 2014

(65) Prior Publication Data

US 2016/0153216 A1 Jun. 2, 2016

(30) Foreign Application Priority Data

Mar. 29, 2013 (JP) ..... 2013-071695
Jul. 11, 2013 (JP) ..... 2013-145217

(51) Int. Cl.
*E05B 81/80* (2014.01)
*E05B 77/12* (2014.01)
*E05B 81/56* (2014.01)

(52) U.S. Cl.
CPC ..... *E05B 81/80* (2013.01); *E05B 77/12* (2013.01); *E05B 81/56* (2013.01)

(58) Field of Classification Search
CPC ..... E05B 81/56; E05B 81/62; E05B 81/64; E05B 77/12; E05B 81/80; E05B 81/58;
(Continued)

(56) References Cited

U.S. PATENT DOCUMENTS 3,723,967 A * 3/1973 Atkins ..... B60R 25/04 180/289
5,713,613 A * 2/1998 Honma ..... E05B 77/48 292/201
(Continued)

FOREIGN PATENT DOCUMENTS

CN 1296593 C 1/2007
FR 2818682 A1 * 6/2002 ..... E05B 77/48
(Continued)

OTHER PUBLICATIONS

English Translation of Chinese Search Report dated Sep. 13, 2016 for the related Chinese Patent Application No. 201480018748.2.
(Continued)

*Primary Examiner* — Christine M Mills
(74) *Attorney, Agent, or Firm* — McDermott Will & Emery LLP

(57) ABSTRACT

A door latching device includes a latch motor connection switch, a converter line which includes a converter power supply, a latch motor and a latch. The latch motor connection switch has an input side connected with the converter line, and an output side connected with the latch motor. The latch is caused to perform an opening operation when the latch motor is driven. Based on an instruction for causing the latch to perform the opening operation, the latch motor connection switch is closed, and the converter power supply is activated to step up an input voltage to the converter power supply and output the input voltage to the latch motor connection switch.

10 Claims, 9 Drawing Sheets

(58) Field of Classification Search
CPC ..... E05B 81/76; E05B 81/77; E05B 81/78; E05B 81/82; E05B 81/86; E05B 81/88; E05B 2047/005; E05B 2047/0053; E05B 2047/0057; E05B 2047/0058; E05B 2047/0097; E05B 2047/0065; Y10T 292/1075; Y10T 292/1079; Y10T 292/1082; Y10T 292/1047; Y10S 292/23; Y10S 292/65
USPC ..... 292/195, 199, 201, 216, DIG. 23, 292/DIG. 65
See application file for complete search history.

(56) References Cited

U.S. PATENT DOCUMENTS 6,056,334 A * 5/2000 Petzold ..... E05B 81/14 292/201
6,439,623 B1 * 8/2002 Lohfeld ..... E05B 81/20 292/201
6,523,376 B2 * 2/2003 Baukholt ..... E05B 81/14 292/201
7,791,218 B2 * 9/2010 Mekky ..... E05B 77/02 307/10.1
8,373,550 B2 * 2/2013 McKee ..... H02P 29/028 296/146.4
2004/0068935 A1 4/2004 Ichikawa et al.
2010/0052337 A1 * 3/2010 Arabia, Jr. ..... E05B 81/82 292/216
2013/0026828 A1 * 1/2013 Iwami ..... G01R 31/3679 307/10.1
2015/0001926 A1 * 1/2015 Kageyama ..... B60R 16/033 307/10.1
2015/0035297 A1 * 2/2015 Brown ..... E05B 81/06 292/336.3
2015/0137531 A1 * 5/2015 Papanikolaou ..... E05B 77/28 292/201
2015/0330116 A1 * 11/2015 Dente ..... E05B 81/86 307/10.1

FOREIGN PATENT DOCUMENTS

JP 2004-108035 4/2004
JP 2007-032140 2/2007
JP 2014033533 A * 2/2014

OTHER PUBLICATIONS

International Search Report of PCT application No. PCT/JP2014/001397 dated May 27, 2014.

* cited by examiner

DOOR LATCHING DEVICE AND MOVING BODY MOUNTED WITH SAME

TECHNICAL FIELD

A technical field relates to a door latching device which is used for various vehicles, and a movable body mounted with the door latching device.

BACKGROUND ART

FIG. 9 is a block diagram of a circuit including conventional door latching device 1. Door latching device 1 includes switch 4 connected to vehicle battery 2 and door handle 3, latch 5, and latch motor 6 which causes latch 5 to perform an opening operation.

When an instruction for opening door 7 is output from door handle 3, switch 4 is closed and power is supplied from vehicle battery 2 to latch motor 6. Further, latch motor 6 is driven to cause latch 5 to perform an opening operation.

Thus, door latching device 1 operates when receiving a supply of power from vehicle battery 2. Hence, door latching device 1 is made smaller and lighter compared to a case where a mechanical opening operation function is employed. As a result, it is possible to make an entire vehicle which is mounted with door latching device 1 lighter, and to improve fuel efficiency (See, for example, Patent Literature 1).

CITATION LIST

Patent Literature

PTL 1: Unexamined Japanese Patent Publication No. 2004-108035

SUMMARY OF THE INVENTION

A door latching device according to the present disclosure includes a latch motor connection switch, a converter line, a latch motor, and a latch. The converter line includes a converter power supply, and is connected to an input side of the latch motor connection switch. The latch motor is connected to an output side of the latch motor connection switch, and is driven when the latch motor connection switch is closed. The latch is caused to perform an opening operation when the latch motor is driven. Based on an instruction for causing the latch to perform the opening operation, the latch motor connection switch is closed, and the converter power supply is activated to step up an input voltage to the converter power supply.

According to this configuration, even when a voltage of the vehicle battery lowers, the latch can normally operate. Consequently, it is not necessary to provide a mechanical opening operation function for an emergency, and it is possible to make the door latching device and the vehicle lighter by employing only the door latching device which has an electric opening operation function.

DESCRIPTION OF EMBODIMENTS

Figure 9:
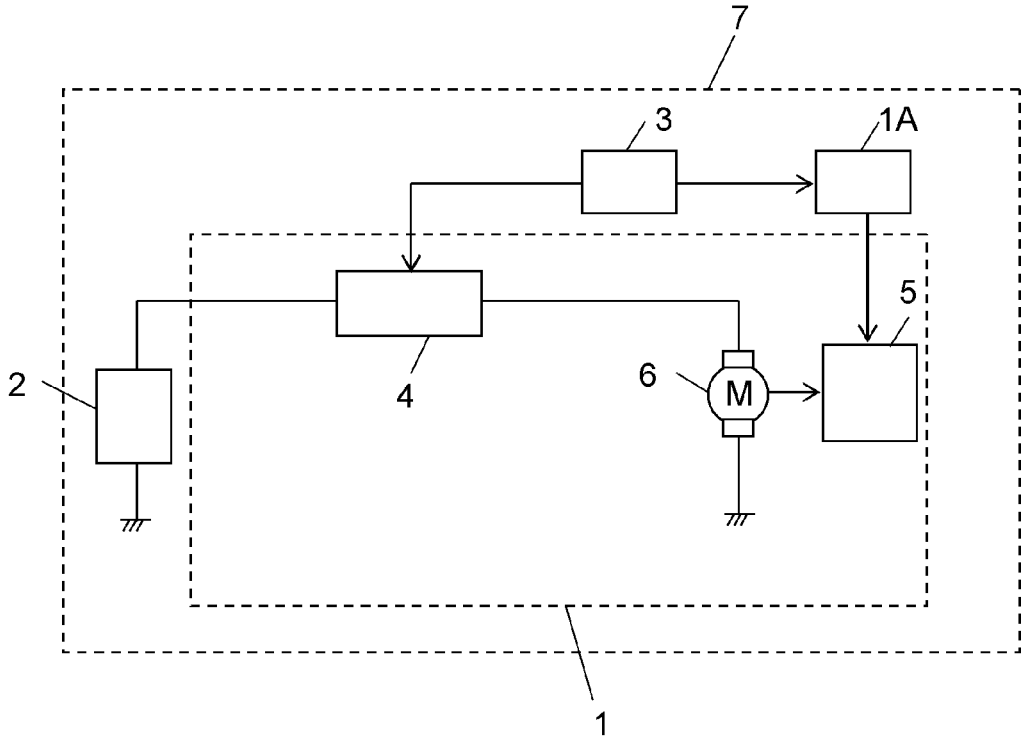
FIG. 9 PRIOR ART
FIG. 9 is a block diagram illustrating a conventional door latching device.

A problem of conventional door latching device 1 illustrated in FIG. 9 is described prior to description of the present exemplary embodiments. According to door latching device 1, when a voltage of vehicle battery 2 lowers, latch motor 6 cannot be driven, and latch 5 does not perform an opening operation. Hence, as a measure for an emergency, door latching device 1 and, in addition, emergency door latching device 1A which has a mechanical opening operation function are provided to one door 7 of a vehicle. As a result, while door latching device 1 is light, an increase in a weight caused by providing emergency door latching device 1A prevents improvement in fuel efficiency.

Hereinafter, various exemplary embodiments will be described with reference to drawings.

In each exemplary embodiment, same components as those in preceding exemplary embodiments will be assigned same reference numerals, and may not be described in detail.

Figure 1:
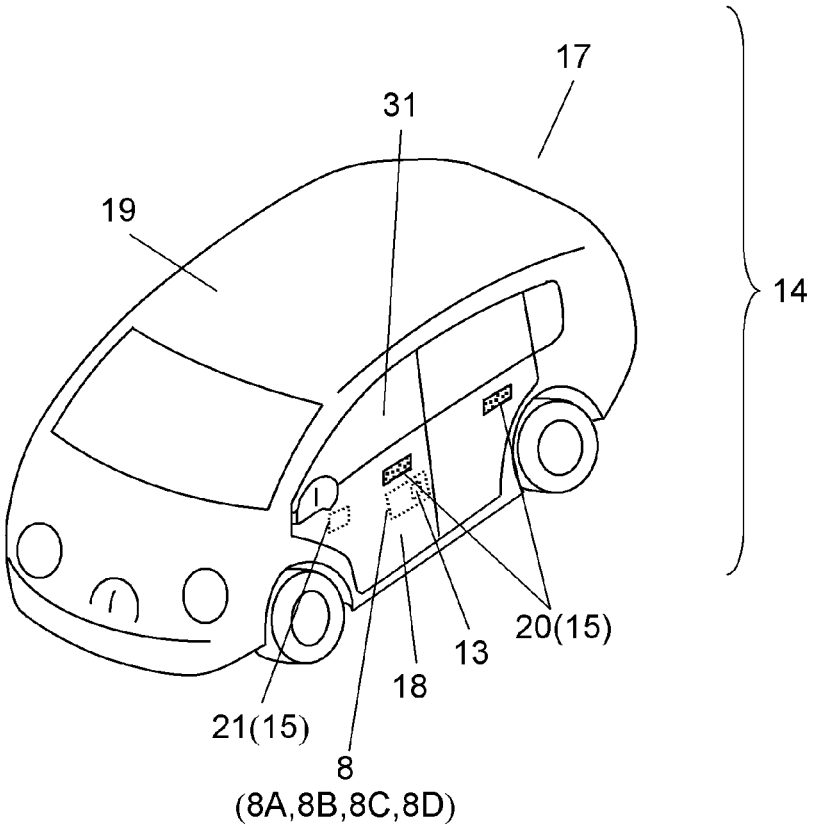
FIG. 1 is an external appearance view of a vehicle mounted with a door latching device according to an exemplary embodiment.

FIG. 1 is an external appearance view of vehicle 14 mounted with door latching devices 8. Vehicle 14 includes body 17, doors 18, and vehicle compartment 19 surrounded by body 17 and doors 18.

Further, opening/closing instructors 15 are provided inside vehicle compartment 19 of vehicle 14 and/or at doors 18. Typical examples of opening/closing instructors 15 are door handles 20 and 21 provided at doors 18. When a user operates door handle 20 from an outside of vehicle 14, latch 13 which engages door 18 with body 17 switches to an open state. At that time, door 18 is in an openable state, and the user can get in or out of vehicle compartment 19. Furthermore, door handles 21 are provided at internal sides of doors 18 in vehicle compartment 19. Still further, when the user operates door handle 21 from a vehicle compartment 19 side of vehicle 14, latch 13 which engages door 18 with body 17 switches to an open state. Thus, door 18 is switched to an openable state. In this regard, door handles 20 and 21 are provided as opening/closing instructors 15. However, opening/instructors 15 are not limited to the handles and may be provided as buttons to vehicle 14.

Each of door latching device 8 is provided at door 18, at body 17, or across door 18 and body 17. Hereinafter, door latching devices 8A to 8D will be described as specific examples of door latching device 8 in the first to third exemplary embodiments.

First Exemplary Embodiment

Figure 2:
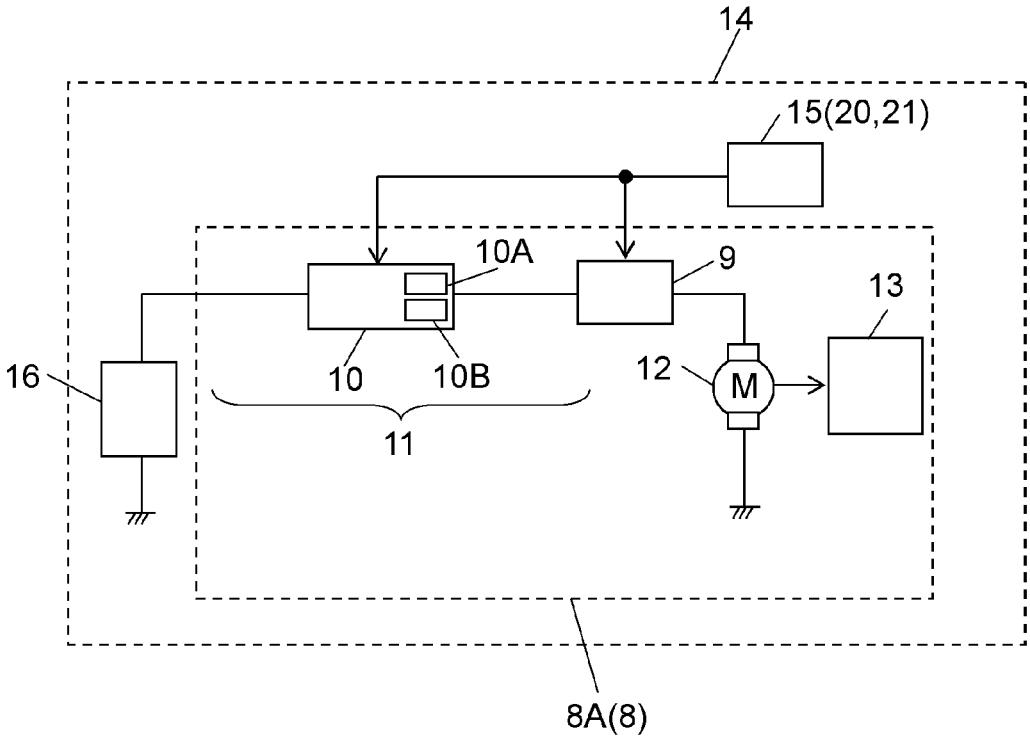
FIG. 2 is a block diagram illustrating the door latching device according to a first exemplary embodiment.

FIG. 2 is a block diagram illustrating door latching device 8A according to the first exemplary embodiment of the present invention.

Door latching device 8A includes latch motor connection switch 9, converter line 11, latch motor 12 and latch 13. Converter line 11 is connected to an input side of latch motor connection switch 9 and includes converter power supply 10. Latch motor 12 is connected to an output side of latch motor connection switch 9, and is driven when latch motor connection switch 9 is closed. Latch 13 is caused to perform an opening operation when latch motor 12 is driven. In this regard, based on a user's instruction for causing latch 13 to perform an opening operation, latch motor connection switch 9 is closed. Further, converter power supply 10 is activated to step up a voltage input to converter power supply 10. Furthermore, the stepped-up voltage is output to latch motor connection switch 9.

According to the above configuration, even when an input voltage to converter power supply 10 lowers, latch 13 can normally perform an opening operation. Consequently, vehicle 14 has only door latching device 8A which has an electric opening operation function for a normal time and an emergency, and, consequently, does not need to have an emergency mechanical opening operation function. As a result, vehicle 14 is made lighter.

A disposition and an operation of door latching device 8A will be described below with reference to FIGS. 1 and 2.

Door handles 20 and 21 may be taken into account as a sort of switches. For example, pull of door handle 20 by the user corresponds to that a switch which is door handle 20 is closed, and latch motor connection switch 9 is closed in conjunction with this operation. That is, a user's operation of pulling door handle 20 is an instruction for closing latch motor connection switch 9. In addition to this, when the user pulls door handle 20, door handle 20 instructs converter power supply 10 to step up a terminal voltage of vehicle battery (hereinafter referred as "battery") 16. That is, the user's operation of pulling door handle 20 is an instruction for activating converter power supply 10.

An operation of causing converter power supply 10 to step up the terminal voltage of battery 16 by activating converter power supply 10 is performed irrespective of a value of the terminal voltage of battery 16. Further, a value of the stepped-up voltage output from converter power supply 10 needs to be at least a minimum voltage which is necessary to drive latch motor 12.

According to the above configuration and operation, in a state where the voltage of battery 16 lowers such as a state where the battery goes flat, it is possible to cause latch 13 to perform an opening operation by using the electric opening operation function. Hence, it is not necessary to provide an emergency mechanical opening operation function to vehicle 14. That is, only door latching device 8A which can support both a normal time and an emergency by using the electric opening operation function is mounted on vehicle 14. Consequently, it is possible to make vehicle 14 lighter and to improve fuel efficiency as a result of making vehicle 14 lighter.

Further, even when vehicle 14 gets involved in a crush, as long as power supply from battery 16 does not completely stop, the electric opening operation function can be activated. When converter line 11 leading from battery 16 to converter power supply 10 is broken or battery 16 is destroyed, power supply from battery 16 completely stops. As long as the power supply does not stop, the electric opening operation function can be activated. Consequently, even when vehicle 14 gets involved in an accident, a passenger can get out of vehicle 14 by operating door handle 21 at the interior side. Further, a third party can rescue passengers to the outside of vehicle 14 from vehicle compartment 19 by operating door handles 20 from the outside of vehicle 14.

Furthermore, a maintenance operator can get in and out of vehicle 14 even when battery 16 has a malfunction. Consequently, the operator can easily recover vehicle 14 to, for example, exchange battery 16. Further, converter power supply 10 operates only when door handle 20 is pulled. Therefore, in a state where the engine is turned off and vehicle 14 completely stops, power is not consumed at all times.

Next, operations of converter power supply 10 and latch motor connection switch 9 will be described in detail.

First, when the user pulls door handle 20, converter power supply 10 receives from door handle 20 an instruction for activating converter power supply 10. Further, converter power supply 10 is activated by using power of battery 16, and measures a terminal voltage of battery 16.

Next, converter power supply 10 compares a measurement value of the terminal voltage of battery 16 with a drivable voltage value of latch motor 12 set in advance. Based on this comparison result, details of a step-up operation of converter power supply 10 and an opening/closing operation of latch motor connection switch 9 are determined.

The aforementioned operation has been described as an example where converter power supply 10 performs an operation of stepping up a terminal voltage of battery 16 irrespective of the terminal voltage value of battery 16. Meanwhile, the operation of converter power supply 10 may be changed according to the terminal voltage value of battery 16.

For example, details of the step-up operation of converter power supply 10 may be determined based on the above comparison result. First, when converter power supply 10 determines that the terminal voltage of battery 16 is higher than the drivable voltage value of latch motor 12 and battery 16 is normal, converter power supply 10 determines that converter power supply 10 does not need to step up the voltage. Further, converter power supply 10 does not cause step-up switching element 10A in converter power supply 10 to perform a switching operation. Thus, converter power supply 10 simply exists as a conductor path, and the terminal voltage of battery 16 is supplied as is to latch motor connection switch 9.

In contrast, when converter power supply 10 determines that the terminal voltage of battery 16 lowers and is lower than the drivable voltage value of latch motor 12 and battery 16 is abnormal, converter power supply 10 determines that converter power supply 10 needs to step up the voltage. Further, converter power supply 10 causes step-up switching element 10A in converter power supply 10 to perform a switching operation. Thus, converter power supply 10 steps up the terminal voltage of battery 16, and supplies the stepped-up voltage to latch motor connection switch 9. Thus, an operation period of converter power supply 10 is limited, including the operation of comparing the terminal voltage of battery 16 and the drivable voltage value of latch motor 12. Consequently, it is possible to reduce power consumption which battery 16 bears.

Alternatively, converter power supply 10 may operate to step up the terminal voltage of battery 16 to the drivable voltage value of latch motor 12 by limiting a step-up period and a step-up range in the period which is necessary at minimum to drive latch motor 12. For example, even in a state where door handle 20 is being continuously pulled, converter power supply 10 needs to operate only for a period shorter than a period in which door handle 20 instructs latch 13 to perform an opening operation. Alternatively, latch motor connection switch 9 needs to be closed only for a period shorter than a period in which door handle 20 instructs latch 13 to perform an opening operation. Thus, an operation period of converter power supply 10 is limited to a shorter period, including the operation of comparing the terminal voltage of battery 16 and the drivable voltage value of latch motor 12. Consequently, it is possible to further reduce power consumption which battery 16 bears. As a result, if the voltage of battery 16 lowers, door latching device 8A can repeatedly operate on many occasions.

Further, as described above, at a point of time at which it is determined that converter power supply 10 performs a step-up operation, converter power supply 10 controls an operation of step-up switching element 10A according to the terminal voltage of battery 16, and outputs a predetermined voltage. Meanwhile, converter power supply 10 may cause step-up switching element 10A to operate irrespective of the terminal voltage of battery 16, and output the stepped-up voltage without adjusting the voltage to a predetermined value. One of both of the above operations needs to be selected according to an allowable range of the drivable voltage of latch motor 12.

Particularly when an upper limit of the drivable voltage of latch motor 12 is sufficiently larger than a standard driving voltage of latch motor 12, converter power supply 10 does not need to have a fine controlling or arithmetic operation function. Hence, by performing control to simply step up the voltage, converter power supply 10 needs to supply, to latch motor 12, only a voltage equal to or greater than a lower limit voltage at which latch motor 12 can be driven. When the upper limit value of the drivable voltage of latch motor 12 is low, converter power supply 10 needs to define an upper limit value of an output voltage and operate. That is, converter power supply 10 needs to output a voltage at which latch motor 12 can be driven and which is in a certain range between the upper limit voltage and the lower limit voltage, instead of outputting a predetermined voltage. After determining that an output voltage of converter power supply 10 is in a certain range, converter power supply 10 supplies power to latch motor 12. Alternatively, after determining that the output voltage of converter power supply 10 is in a a certain range while outputting the voltage, converter power supply 10 causes latch motor connection switch 9 to close. Thus, power may be supplied to latch motor 12.

A case where converter power supply 10 operates to step up a voltage has been described above. However, converter power supply 10 may operate to step down a voltage. When, for example, converter power supply 10 determines that the terminal voltage of battery 16 is sufficiently high and converter power supply 10 needs to step down the voltage, step-down switching element 10B performs a switching operation and converter power supply 10 outputs the stepped-down voltage. Further, converter power supply 10 supplies the stepped-down voltage to latch motor 12 through latch motor connection switch 9.

That is, converter power supply 10 has both of functions related to step-up and step-down operations, and when an input voltage to converter power supply 10 is a predetermined threshold or greater and is lower than the predetermined threshold, converter power supply 10 functions differently. Particularly when the drivable voltage range of latch motor 12 is narrow, converter power supply 10 can cause latch motor 12 to adequately operate by limiting the range of the output voltage by a step-up operation and a step-down operation.

Figure 3:
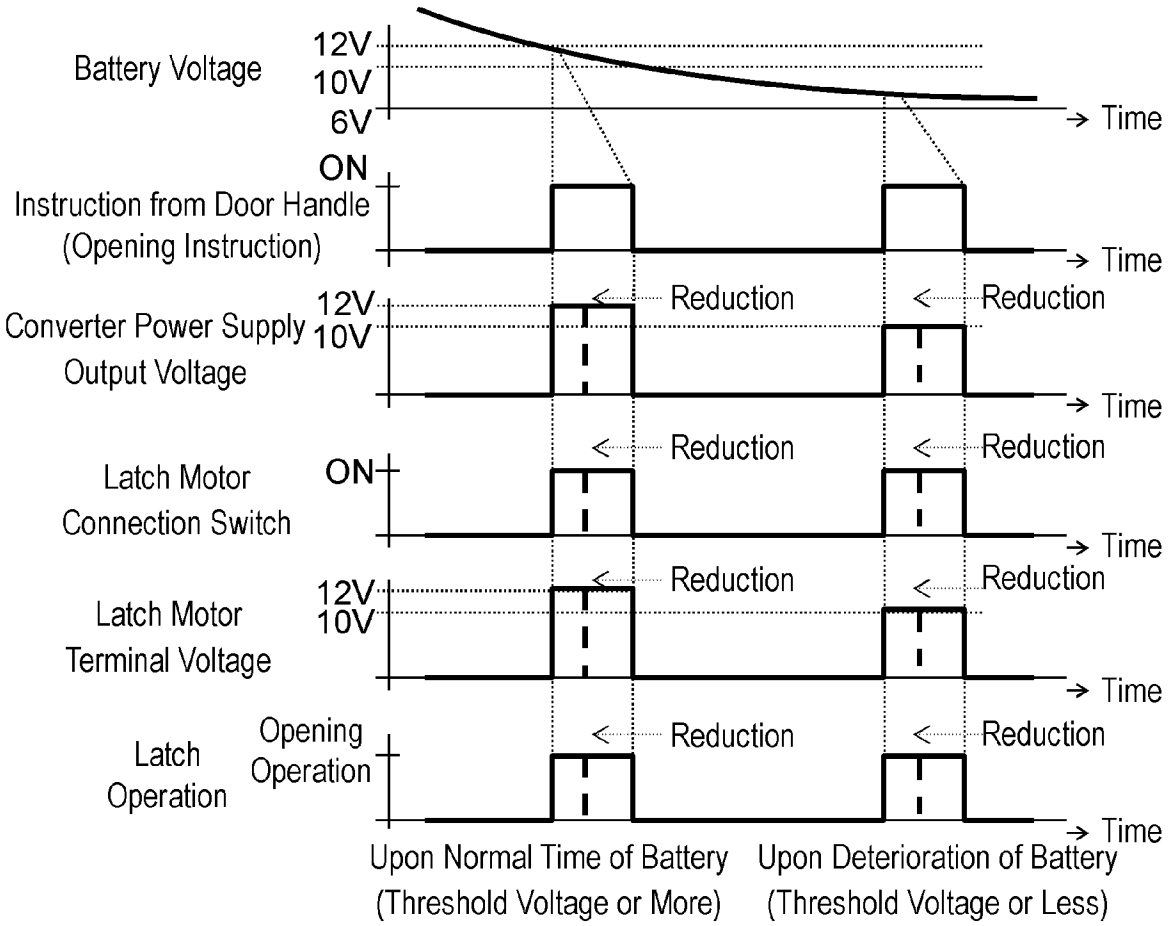
FIG. 3 is a time-sequence diagram of an operation state of a vehicle mounted with the door latching device according to the first exemplary embodiment, and a door latch.

Next, the operation of door latching device 8 (8A) employing the configuration illustrated in FIGS. 1 and 2 will be described with reference to FIG. 3. FIG. 3 is a time-sequence diagram illustrating an operation state of a vehicle and door latching device 8A mounted on the vehicle. A curve of a "Battery Voltage" indicates a fluctuation of the voltage of battery 16 which is a main power supply. A curve of "Instruction from Door Handle" indicates an opening instruction or a change in a maintained closed state made when door handle 20 or 21 is pulled. A curve of "Converter Power Supply Output Voltage" indicates a fluctuation of an output voltage of converter power supply 10. A curve of "Latch motor Connection Switch" indicates a change in an opened state or a closed state of latch motor connection switch 9. A curve of "Latch Motor Terminal Voltage" indicates a fluctuation of a terminal voltage of latch motor 12. Further, a curve of "Latch Operation" indicates a change in an opening operation or a closed state of latch 13.

In this regard, the curve of "Battery Voltage" in particular indicates a state where the voltage of battery 16 lowers when a vehicle is left for several weeks or several months as a lapse of time which is indicated by a horizontal axis. In contrast, the curve of "Instruction From Door Handle", the curve of "Converter Power Supply Output Voltage", the curve of "Latch Motor Connection Switch", the curve of "Latch Motor Terminal Voltage" and the curve of "Latch Operation" indicate changes in states in about several seconds.

Further, for example, when converter power supply 10 performs a step-up operation, the output voltage of converter power supply 10 is 10 V which is a rated output value. This voltage is also an example of an adequate value for driving latch motor 12.

First, when the terminal voltage of battery 16 is 10 V of a threshold or greater and is in a normal state, and when the user pulls door handle 20, the curve of "Instruction From Door Handle" switches an on state of an opening instruction. Converter power supply 10 operates according to the opening instruction. However, the terminal voltage of battery 16 is the threshold or greater, and therefore, when converter power supply 10 has only a step-up function, converter power supply 10 outputs the terminal voltage of battery 16 without changing. In contrast, when converter power supply 10 has a step-down function, converter power supply 10 outputs 10 V which is a rated output value.

On the other hand, when the terminal voltage of battery 16 is less than 10 V, upon pull of door handle 20 or 21 by the user, the curve of "Instruction From Door Handle" switches to the on state of the opening instruction. Converter power supply 10 operates according to the opening instruction. In this case, by using the step-up function of converter power supply 10, converter power supply 10 steps up the terminal voltage of battery 16, and outputs 10 V which is a rated output value.

Meanwhile, the curves of "Latch Motor Connection Switch", "Latch Motor Terminal Voltage" and "Latch Operation" approximately correspond to a logical product of the curves of "Instruction From Door Handle" and "Converter Power Supply Output Voltage". On/off timings of instructions, operations and voltages approximately indicate matching shapes.

When converter power supply 10 operates to step up or step down the voltage, converter power supply 10 needs to operate only in a period which is necessary at minimum to drive latch motor 12. Thus, when a limitation is placed on the operation period, the curves of "Converter Power Supply Output Voltage", "Latch Motor Connection Switch", "Latch Motor Terminal Voltage", and "Latch Operation" have shapes of reduced periods as indicated by broken lines. That is, converter power supply 10 supplies power to latch motor 12 in a period of time shorter than a period of time in which converter power supply 10 receives from door handle 20 an instruction for causing latch 13 to perform an opening operation.

Alternatively, without shortening the operation period of converter power supply 10, latch motor connection switch 9 performs a connection operation in a shorter period of time than a period of time in which converter power supply 10 receives from door handle 20 an instruction for causing latch 13 to perform an opening operation. In this case, converter power supply 10 supplies power to latch motor 12 in a shorter period of time than an opening operation instruction. Thus, the curves of "Latch Motor Terminal Voltage" and "Latch Operation" approximately correspond to a logical product of the curves of "Converter Power Supply Output Voltage" and "Latch Motor Connection Switch". As a result, power consumption which battery 16 bears is suppressed as described above, and, even in a state where the voltage of battery 16 lowers, door latching device 8A can repeatedly operate on many occasions.

In this example, converter power supply 10 compares the terminal voltage of battery 16 and a predetermined threshold to determine which one of the step-up operation and the step-down operation is to be performed. Further, this threshold is 10 V, and a stepped-up or stepped-down correction value is also 10 V. However, these threshold and correction value do not need to match. For example, a threshold for making determination as to the step-up operation may be defined as 9 V, and the stepped-up correction value may be defined as 9.5 V, that is, a sensitivity for the step-up operation is lowered, and the step-up range may be reduced. Thus, it is possible to further suppress deterioration of battery 16.

Second Exemplary Embodiment

Figure 4:
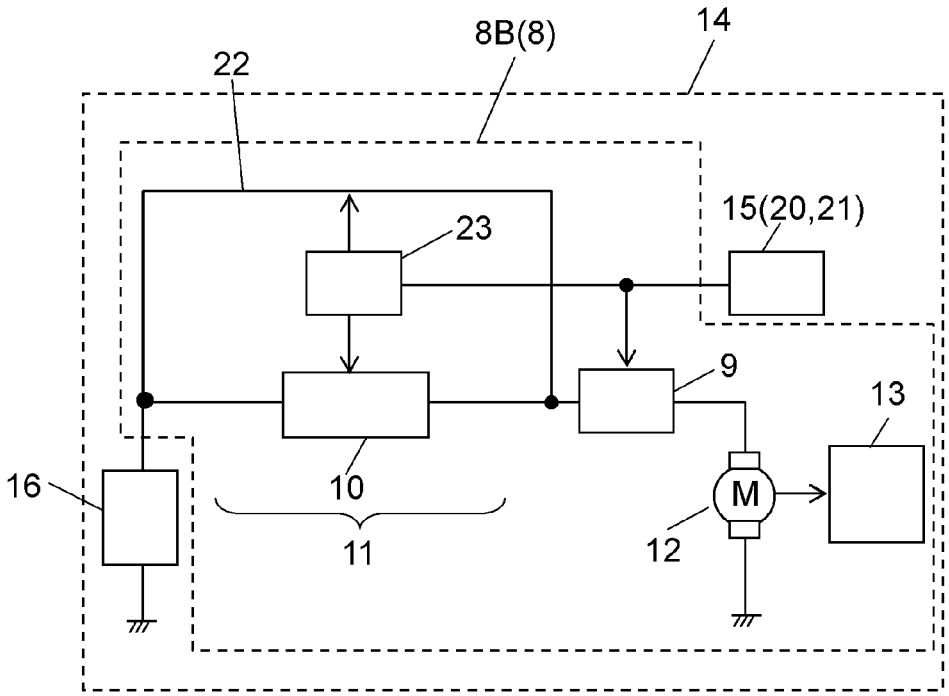
FIG. 4 is a block diagram illustrating a door latching device according to a second exemplary embodiment.

FIG. 4 is a block diagram illustrating door latching device 8B according to the second exemplary embodiment of the present invention. Door latching device 8B includes power supply line 22 and controller 23 in addition to the configuration of door latching device 8A. Power supply line 22 connects battery 16 to an input side of latch motor connection switch 9. That is, converter line 11 and power supply line 22 are connected in parallel to each other. Further, controller 23 is connected to door handles 20. Others are the same as those in door latching device 8A. Further, controller 23 controls an operation of converter power supply 10. When opening/closing instructor 15 makes an instruction for causing latch 13 to perform an opening operation, latch motor connection switch 9 is closed. Further, power is supplied from battery 16 to latch motor 12 through converter power supply 10 or power supply line 22. Furthermore, in this case, converter power supply 10 is activated as necessary, and converter power supply 10 steps up the voltage supplied from battery 16 to converter power supply 10.

According to the configuration described above, even when a voltage of battery 16 lowers, latch 13 can normally perform an opening operation. Consequently, it is not necessary to provide a mechanical opening operation function for an emergency by using only door latching device 8B having the electric opening operation function both for a normal time and an emergency, and it is possible to make door latching device 8B and vehicle 14 lighter. That is, even when only door latching device 8B having the electric opening operation function is mounted on vehicle 14 and the voltage of battery 16 lowers, the user can get in and out of vehicle 14. Consequently, the user can get out of a vehicle upon an emergency or exchange battery 16, i.e., easily take recovery measure for vehicle 14. In addition to this, it is possible to improve fuel efficiency of vehicle 14.

Further, door latching device 8B includes a path in which converter line 11 and power supply line 22 are parallel in order to supply power to latch motor 12. Consequently, when vehicle 14 gets involved in some accident, as long as converter line 11 or power supply line 22 is normal, battery 16 can continue supplying power to latch motor 12.

Hereinafter, a disposition and an operation of door latching device 8B will be described with reference to FIG. 4. An external appearance view of vehicle 14 which is mounted with door latching device 8B is the same as that in FIG. 1.

Door latching device 8B includes latch motor connection switch 9, converter line 11, latch motor 12, latch 13, power supply line 22, and controller 23. Converter line 11 is connected to an input side of latch motor connection switch 9 and includes converter power supply 10. Latch motor 12 is connected to an output side of latch motor connection switch 9, and is driven when latch motor connection switch 9 is closed. Latch 13 is caused to perform an opening operation when latch motor 12 is driven. Power supply line 22 is connected to an input side of latch motor connection switch 9, and is connected in parallel to converter line 11. Controller 23 is connected to power supply line 22 and converter power supply 10.

When the user operates door handle 20 corresponding to opening/closing instructor 15, latch motor connection switch 9 is closed. Further, converter power supply 10 is provided to converter line 11, and battery 16 supplies power to latch motor 12 through converter line 11 and latch motor connection switch 9 or through power supply line 22 and latch motor connection switch 9.

As described above, the user makes an instruction for causing latch 13 to perform an opening operation. More specifically, the user pulls door handle 20 from the outside of vehicle 14 or pulls door handle 21 from the inside of vehicle compartment 19 to make an instruction to switch latch 13 to an opened state. Hence, door handles 20 and 21 need to be taken into account as a sort of switches. For example, pull of door handle 20 by the user corresponds to that a switch which is door handle 20 is closed, and latch motor connection switch 9 is closed in conjunction with this operation. That is, a user's operation of pulling door handle 20 is an instruction for closing latch motor connection switch 9.

In addition to this, when the user pulls door handle 20, controller 23 instructs converter power supply 10 to step up the terminal voltage of battery 16. That is, a user's operation of pulling door handle 20 makes an instruction to activate controller 23 and to activate converter power supply 10 through controller 23.

Controller 23 starts operating in response to user's pulling of door handle 20, controls the operation of converter power supply 10 and detects voltage values of converter power supply 10 and power supply line 22. In this case, controller 23 detects the voltage value of power supply line 22 in particular and compares the detected voltage and a predetermined threshold to determine whether or not battery 16 is in a normal state or an abnormal state.

When the voltage value of power supply line 22 is the predetermined threshold or greater, controller 23 keeps stopping converter power supply 10 without activating converter power supply 10. Thus, battery 16 does not supply power to latch motor connection switch 9 through converter power supply 10. This state corresponds to a state where the terminal voltage of battery 16 is normal and battery 16 is not deteriorated nor damaged.

On the other hand, when the voltage value of power supply line 22 is less than the predetermined threshold, controller 23 activates converter power supply 10. Thus, battery 16 supplies power to latch motor connection switch 9 through converter power supply 10. This state corresponds to a state where the terminal voltage of battery 16 is abnormal and battery 16 is deteriorated or damaged. Meanwhile, the predetermined threshold described herein can be defined by using a voltage value at which latch motor 12 can be driven, as a reference.

When the user pulls door handle 20, controller 23 performs detection and an operation as described above, and performs control to close latch motor connection switch 9. Door handle 20 may control the operation of closing latch motor connection switch 9 at the same time at which door handle 20 is pulled.

According to the above configuration and operation, even in a situation that the voltage of battery 16 lowers since, for example, battery 16 goes flat, door latching device 8B can cause latch 13 to perform an operation by using the electric opening operation function. Hence, it is not necessary to provide a mechanical opening operation function for an emergency to the vehicle. Consequently, by mounting only door latching device 8B having the electric opening operation function for a normal time and an emergency, it is possible to make the vehicle lighter or improve fuel efficiency.

Further, when battery 16 is normal in door latching device 8B, i.e., during most of a period in which vehicle 14 is operating, battery 16 supplies power by using power supply line 22 which does not include an electric element. In this regard, a diode (not illustrated) is connected to power supply line 22 in such a manner that the cathode side thereof is on a battery 16 side in order that the diode prevents a reverse flow. However, when the diode operates in a forward direction, while a forward voltage drops slightly, power is not significantly lost. Consequently, when battery 16 is normal, it is possible to minimize power loss. As a result, door latching device 8B can prevent deterioration of battery 16. Further, when battery 16 is normal, converter power supply 10 stops an operation which consumes significant power. Consequently, it is possible to prevent deterioration of battery 16 also in this point of view.

In the operation of door latching device 8B, controller 23 detects a voltage value of power supply line 22. However, controller 23 may detect a voltage value of an input end of latch motor connection switch 9. Consequently, controller 23 can detect abnormalities which occur at all portions of power supply line 22. That is, controller 23 can detect a wide range of abnormalities which occur at the battery 16 side of latch motor connection switch 9.

Figure 5:
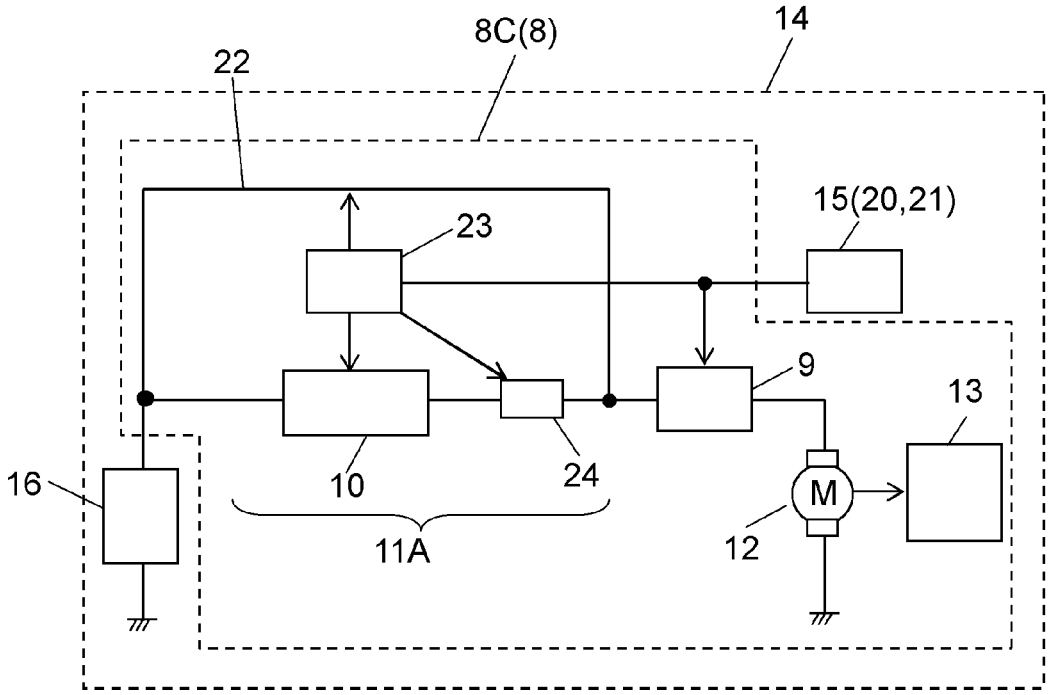
FIG. 5 is a block diagram illustrating another door latching device according to the second exemplary embodiment.

Further, as door latching device 8C illustrated in the block diagram of FIG. 5, switching element 24 may be disposed between an output side of converter power supply 10 and latch motor connection switch 9. That is, converter power supply 10 and switching element 24 may be disposed in converter line 11A. Switching element 24 is connected in series to the output side of converter power supply 10.

When the voltage value of power supply line 22 is the predetermined threshold or greater, controller 23 activates converter power supply 10 and controls switching element 24 to make it to a blocked state. Thus, battery 16 does not supply power to latch motor connection switch 9 through converter power supply 10. This operation is applied to a state where the terminal voltage of battery 16 is normal and battery 16 is not deteriorated nor damaged.

On the other hand, when the voltage value of power supply line 22 is less than the predetermined threshold, controller 23 performs control to activate converter power supply 10. In addition to this, when detecting that the output voltage of converter power supply 10 is higher than the predetermined value, controller 23 performs control to switch switching element 24 from a blocked state to a connection state. Thus, battery 16 supplies power to latch motor connection switch 9 through converter power supply 10. This operation is applied to a state where the terminal voltage of battery 16 is abnormal and battery 16 is deteriorated or damaged. Further, the predetermined threshold described herein can be defined by using a voltage value at which latch motor 12 can be driven, as a reference, similar to the above.

As described above, controller 23 compares the voltage detected by power supply line 22 and the threshold set in advance. When controller 23 determines that the voltage detected by power supply line 22 is lower than the threshold, controller 23 instructs converter power supply 10 to activate a step-up operation and performs control to switch switching element 24 from the blocked state to the connection state. Then, latch motor connection switch 9 is closed based on an instruction from door handle 20. Thus, the voltage stepped up by converter power supply 10 is supplied to latch motor connection switch 9 and latch motor 12.

In this case, the voltage stepped up by converter power supply 10 is higher than the voltage of power supply line 22. Hence, a reverse current flowing from the output side of converter power supply 10 to battery 16 through power supply line 22 may be generated. In order to prevent the reverse current, a reverse current preventing element (not illustrated) can be disposed in power supply line 22. This reverse current preventing element needs to be opened in synchronization with the operation of converter power supply 10. Alternatively, the reverse current preventing element needs to be opened after controller 23 instructs converter 10 to activate the step-up operation, and before converter power supply 10 starts the step-up operation.

Figure 6:
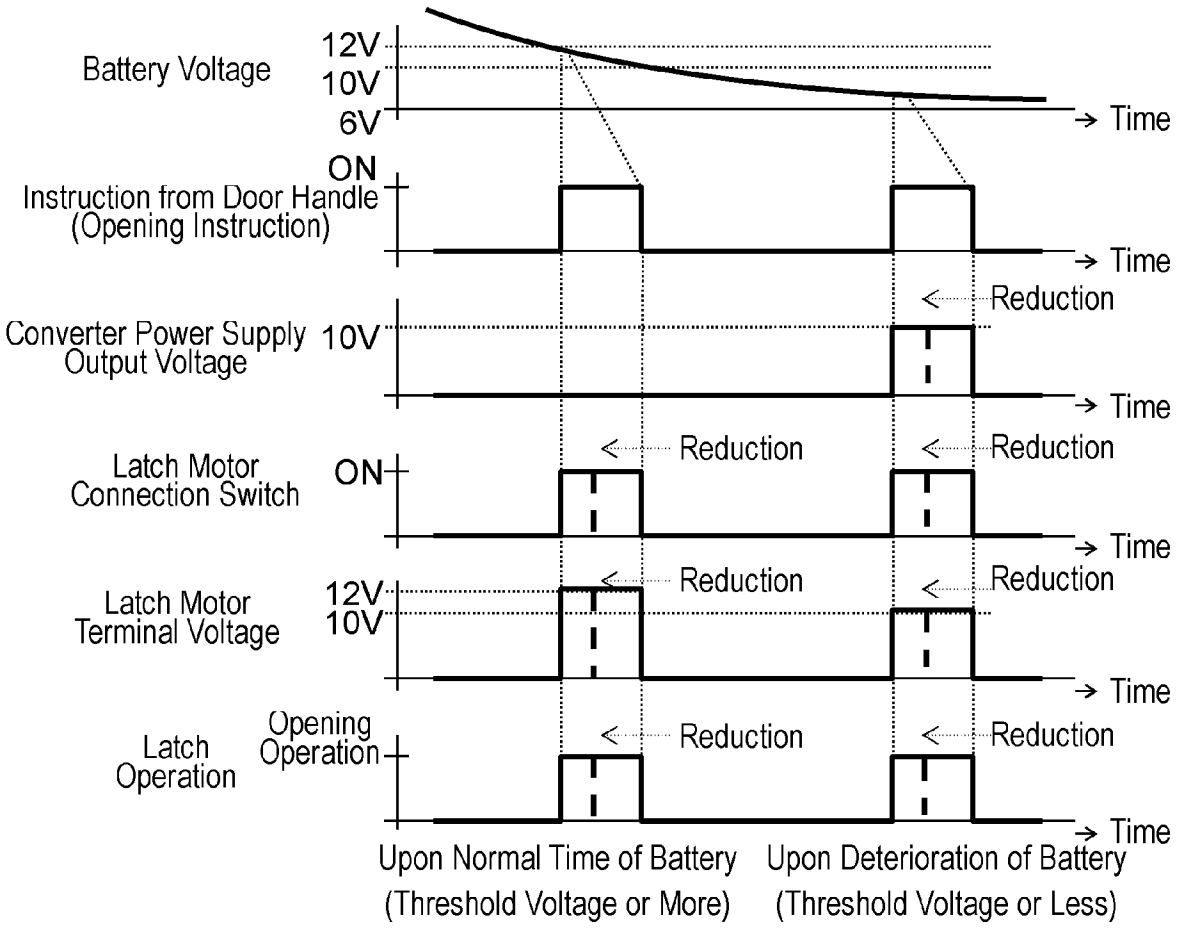
FIG. 6 is a time-sequence diagram of an operation state of a vehicle mounted with the door latching device according to the second exemplary embodiment, and a door latch.

Next, operations of door latching devices 8B and 8C employing the configurations illustrated in FIGS. 4 and 5 will be described with reference to FIG. 6. FIG. 6 is a time-sequence diagram illustrating an operation state of a vehicle and door latching device 8B or door latching device 8C mounted on the vehicle. The curves are the similar as those in FIG. 3.

First, when the terminal voltage of battery 16 is 10 V of a threshold or greater and battery 16 is in a normal state, and when the user pulls door handle 20, the curve of "Instruction From Door Handle" switches to an on-state of an opening instruction. Converter power supply 10 operates upon the opening instruction. However, when the terminal voltage of battery 16 is the threshold or greater, converter power supply 10 does not output the voltage.

On the other hand, when the terminal voltage of battery 16 is less than the threshold and the user pulls door handle 20, the curve of "Instruction From Door Handle" switches to the on-state of the opening instruction. Converter power supply 10 operates upon this opening instruction. In this case, the step-up function of converter power supply 10 operates, and converter power supply 10 steps up the terminal voltage of battery 16 and outputs 10 V which is the rated output value.

According to the above operation, power consumption which battery 16 bears is suppressed, and door latching devices 8B and 8C can repeatedly operate on many occasions even in a state where battery 16 is deteriorated.

Each of converter power supplies 10 of door latching devices 8B and 8C described herein has the step-up operation function, but may has both functions of the step-up operation and the step-down operation. In this case, converter power supply 10 compares the terminal voltage of battery 16 and a predetermined threshold to determine which one of the step-up operation and the step-down operation is performed. Furthermore, this threshold is 10 V as illustrated in FIG. 6, and a stepped-up or stepped-down correction value is also 10 V. However, these threshold and correction value do not need to be the same.

Third Exemplary Embodiment

Door latching devices 8A, 8B and 8C described in the first and second exemplary embodiments can operate even when battery 16 is deteriorated. Door latching device 8D described below can operate even when battery 16 is damaged and cannot discharge.

Figure 7:
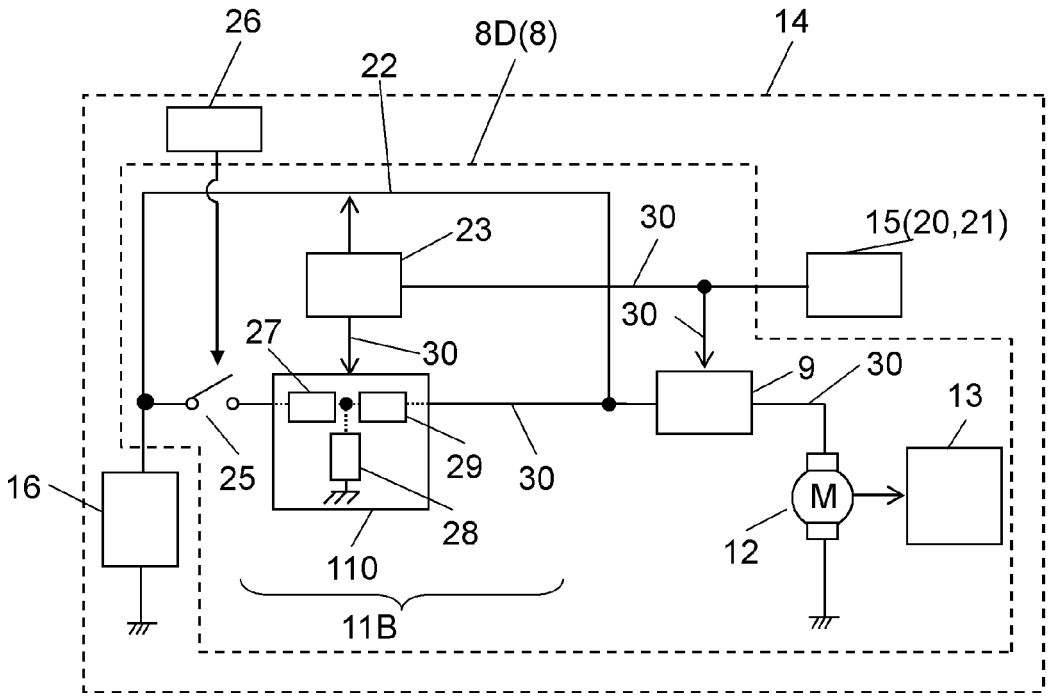
FIG. 7 is a block diagram illustrating a door latching device according to a third exemplary embodiment.

FIG. 7 is a block diagram illustrating door latching device 8D according to the third exemplary embodiment of the present invention. Door latching device 8D includes latch motor connection switch 9, converter line 11B, latch motor 12, latch 13, power supply line 22 and controller 23. Latch motor connection switch 9 is opened and closed based on an instruction from opening/closing instructor 15 provided to vehicle 14. Converter line 11B connects battery 16 disposed in vehicle 14 to an input side of latch motor connection switch 9. Converter line 11B includes converter power supply 110 and interlock switch 25. Latch motor 12 is connected to an output side of latch motor connection switch 9. Further, battery 16 is connected to the input side of latch motor connection switch 9 by power supply line 22.

That is, converter line 11B and power supply line 22 are connected in parallel. Further, controller 23 is connected to door handles 20. Furthermore, controller 23 detects the voltage of power supply line 22, and controls an operation of converter power supply 110. When latch motor connection switch 9 is closed, latch 13 performs an opening operation because latch motor 12 is driven. Consequently, when opening/closing instructor 15 gives an instruction to make latch 13 to perform an opening operation, latch motor connection switch 9 is closed. Further, power is supplied to latch motor 12 from converter power supply 110 or through power supply line 22. Furthermore, converter power supply 110 is activated when necessary, to supply power from converter power supply 110 to latch motor 12.

Here, an operation in case where door latching device 8D is mounted on vehicle 14 is described as an example. Hence, the operation of door latching device 8D is based on a time at which interlock switch 25 or engine switch 26 of vehicle 14 is switched from "OFF" to "ON" or is ON. In addition, taking into account that door latching device 8D operates alone, the operation of door latching device 8D may be based on a time at which a power supply instruction to converter power supply 110 is switched from "OFF" to "ON" or is ON.

Converter power supply 110 has an electricity storage function, and, when engine switch 26 of vehicle 14 switches to ON, converter power supply line 110 starts charging therein. When engine switch 26 of vehicle 14 is ON, controller 23 continuously detects a voltage value of power supply line 22, and compares the voltage of power supply line 22 and a predetermined threshold.

First, when engine switch 26 is ON and the voltage of power supply line 22 is the threshold or greater, converter power supply 110 continues operating. That is, converter power supply 110 continues stepping up the voltage and charging. In this case, controller 23 controls an operation of converter power supply 110. Power supply line 22 supplies power from battery 16 to latch motor connection switch 9. In this case, the voltage of power supply line 22 is the threshold or greater, and therefore controller 23 determines that power supply from battery 16 is in a normal state.

On the other hand, when the voltage of power supply line 22 is less than the threshold even though an instruction to engine switch 26 is ON, converter power supply line 110 stops operating, switches to a pause state and stops stepping up the voltage and charging. Thereafter, when the user instructs door handle 20 to perform an opening operation, and door latching device 8D receives the instruction for causing latch 13 to perform an opening operation, latch motor connection switch 9 is closed. In conjunction with the operation, converter power supply 110 shifts from a stop state to an operation state, starts operating again and supplies power to latch motor 12 through latch motor connection switch 9. That is, converter power supply line 110 resumes stepping up the voltage and charging. However, an input voltage to converter power supply 110 is low or none, and therefore converter power supply 110 is hardly charged actually. At this time, as the voltage of power supply line 22 is lower than the threshold, controller 23 determines that power supply from battery 16 is in an abnormal state.

According to the above configuration and operation, when an input voltage from battery 16 is low, it is possible to cause latch 13 to perform an opening operation by using only the electric opening operation function similar to the first exemplary embodiment. Hence, it is not necessary to provide an emergency mechanical opening operation function to vehicle 14. That is, only door latching device 8D which can support both a normal time and an emergency by using the electric opening operation function is mounted on vehicle 14. Consequently, it is possible to make vehicle 14 lighter and improve fuel efficiency as a result of making vehicle 14 lighter.

Further, when vehicle 14 gets involved in a crush, and particularly when battery 16 is damaged or power supply line 22 is cut, power supply from battery 16 stops. Even in such a case, by using power stored in converter power supply 110, it is possible to activate the electric opening operation function. Consequently, even when vehicle 14 gets involved in an accident, a user onboard can get out of the vehicle by operating door handle 21. Further, a third party can rescue passengers to an outside of the vehicle from vehicle compartment 19 by operating door handle 20 from the outside of vehicle 14 after the accident.

Detail of a disposition and an operation of door latching device 8D which can operate even when battery 16 loses a power supply function will be described in detail hereinafter with reference to FIG. 7.

Door latching device 8D includes latch 13, latch motor 12, latch motor connection switch 9, converter line 11B and power supply line 22 connected in parallel to converter line 11B.

Interlock switch 25 which interlocks with engine switch 26 and converter power supply 110 are connected in series and disposed in converter line 11B. Further, battery 16 supplies power to latch motor 12 through converter line 11B and latch motor connection switch 9 or through power supply line 22 and latch motor connection switch 9.

Similar to the first and second exemplary embodiments, the user gives an instruction to make latch 13 to perform an opening operation. More specifically, the user pulls door handle 20 from the outside of vehicle 14 or pulls door handle 21 from the inside of vehicle compartment 19 to switch latch 13 to an opened state.

Door latching device 8D operates in the following order to switch latch 13 to the opened state. First, the user performs an operation of pulling door handle 20 to activate controller 23. Next, controller 23 detects the voltage value of power supply line 22 and compares the detected voltage and a predetermined threshold to determine whether or not battery 16 is in a normal state or an abnormal state.

When the voltage value of power supply line 22 is the predetermined threshold or greater, battery 16 supplies power to latch motor connection switch 9 and latch motor 12 through power supply line 22. Then, although converter power supply 110 operates, converter power supply 110 does not output power or outputs weak power of a small current at a low voltage. An operation performed in a case where engine switch 26 and interlock switch 25 which interlocks with engine switch 26 are ON is substantially the same as that in case where engine switch 26 and interlock switch 25 are OFF, when the voltage value of power supply line 22 is the predetermined threshold or greater.

When engine switch 26 and interlock switch 25 are ON, converter power supply 110 continues operating for charging and does not output power or outputs weak power.

Converter power supply 110 includes charging circuit 27, discharging circuit 29 and electricity storage element 28. Discharging circuit 29 is connected to latch motor connection switch 9, charging circuit 27 is connected to discharging circuit 29 in series, and one end of electricity storage element 28 is connected to a connection point of charging circuit 27 and discharging circuit 29.

When engine switch 26 and interlock switch 25 are switched from OFF to ON, converter power supply 110 starts charging and discharging. That is, controller 23 causes charging circuit 27 of converter power supply 110 to operate for charging to charge electricity storage element 28, and causes discharging circuit 29 to operate for discharging at a low duty ratio to consume power of electricity storage element 28. At this time, an output current from discharging circuit 29 is nearly 0 A. This state corresponds to a state where the terminal voltage of battery 16 is normal and battery 16 is not deteriorated nor damaged.

On the other hand, when the voltage value of power supply line 22 is lower than the predetermined threshold, the operation of door latching device 8D differs depending on a state of engine switch 26.

In a first state where engine switch 26 has been previously switched from an ON state to an OFF state accurately and is in the OFF state, an operation of door latching device 8D will be described. This state corresponds to, for example, a case where vehicle 14 is left for a long period of time and a terminal voltage of battery 16 lowers.

Controller 23 is activated when door handle 20 is pulled. Then, controller 23 determines that the voltage of battery 16 lowers, based on a result obtained by comparing the voltage of power supply line 22 and the predetermined threshold. Next, controller 23 causes discharging circuit 29 to step up power stored in electricity storage element 28. The stepped-up voltage is supplied to latch motor 12 through latch motor connection switch 9, and latch 13 switches to the opened state. According to the above operation, door latching device 8D can open and close doors 18 by using the electric opening operation function without using the mechanical opening operation function even in a state where the voltage of battery 16 lowers.

Next, in a second state where the voltage of power supply line 22 is lower than the predetermined threshold even though an instruction of engine switch 26 is ON, an operation of door latching device 8D will be described. A state where the voltage of power supply line 22 suddenly lowers during the operation of vehicle 14 corresponds to, for example, a case where an instruction of engine switch 26 is in an ON state and, during the operation of vehicle 14, a terminal voltage of battery 16 suddenly lowers and vehicle 14 stops operating. That is, this state corresponds to a case where vehicle 14 gets involved in an accident and battery 16 falls into a critical situation. Controller 23 determines that vehicle 14 and battery 16 are in an emergency, based on a result obtained by comparing the voltage of power supply line 22 and the predetermined threshold. Next, controller 23 stops an operation of converter power supply 110. That is, controller 23 stops the operation of charging circuit 27 and stops the operation of discharging circuit 29, and controls converter power supply 110 to maintain power stored in electricity storage element 28.

The stop state of converter power supply 110 is a temporary stop. That is, converter power supply 110 can immediately restart when receiving an instruction from controller 23. Meanwhile, controller 23 receives, from electricity storage element 28, power which enables controller 23 to perform an arithmetic operation, and can operate irrespective of the terminal voltage of battery 16. Hence, power is supplied to controller 23 from battery 16 when the terminal voltage of battery 16 is normal and from converter power supply 110 when the terminal voltage of battery 16 is detected as an abnormality. When a passenger or a rescuer outside the vehicle pulls door handle 21 or 20, controller 23 can instruct converter power supply 110 to restart. Converter power supply 110 including electricity storage element 28 and discharging circuit 29 causes discharging circuit 29 to step up power stored in electricity storage element 28 based on the instruction of controller 23, and supplies the power to latch motor 12 through latch motor connection switch 9.

Power for activating controller 23, power for opening or closing latch motor connection switch 9 and power for activating converter power supply 110 are supplied from battery 16 or electricity storage element 28 to support both cases where a voltage value of power supply line 22 is higher and lower than the predetermined threshold.

According to the above operation, power stored in electricity storage element 28 of converter power supply 110 except for weak power applied to maintain the function of controller 23 can be supplied to latch motor 12 after being stepped up by discharging circuit 29. In particular, converter power supply 110 stores power for an emergency case where vehicle 14 is in an emergency and power is lost and discharges only when receiving an instruction from door handle 20, and door latching device 8D activates latch motor 12. Hence, door latching device 8D can perform an opening operation irrespective of an aftermath of an accident, and performs a continuous opening operation or intermittently performs a repeated opening operation. That is, even in a situation that vehicle 14 gets involved in an accident, battery 16 falls in a critical situation and a great amount of time is required to rescue passengers from this accident, rescuers can repeatedly perform an opening operation of door latching device 8D from an outside of vehicle 14 not only once.

Meanwhile, controller 23, converter power supply 110, latch motor connection switch 9, latch motor 12 and latch 13 can be collectively disposed inside door 18 for which latch 13 is caused to perform an opening operation. That is, all connection bodies 30 which are conductors configured to connect individual function elements in door latching device 8D can be shorter than power supply line 22 which is a normal power supply path. Door latching device 8D in particular can be made smaller and lighter and operate to support an emergency such as an accident. Hence, even when vehicle 14 gets involved in an accident, door latching device 8D is less likely to incur a damage such as breaking since connection bodies 30 are short, and improve operation reliability of converter power supply 110 in particular. That is, it is easy to maintain the function of door latching device 8D by reducing a likelihood that connection bodies 30 are damaged compared to a likelihood that power supply line 22 is damaged.

Further, as described above, door latching device 8D can support a normal time and an emergency by using the electric opening operation, and door latching device 8D can be made smaller and lighter. Consequently, door latching device 8D can be disposed anywhere in door 18. For example, door latching device 8D may be disposed at a position close to a hinge side of door 18 to avoid an influence of vibration caused when door 18 is opened or closed. Alternatively, door latching device 8D can be disposed at a position at which an adequate moment is produced at door 18 to allow the user to adjust a necessary force applied when door 18 is opened or closed.

Further, when controller 23 determines that a terminal voltage of battery 16 suddenly lowers and vehicle 14 gets involved in an accident while vehicle 14 is operating in an ON state of engine switch 26, and when a passenger or a rescuer operates door handle 20, latch 13 performs an opening operation and window 31 disposed close to latch 13 may be caused to perform an opening operation. Consequently, multiple routes for passengers to get out of vehicle 14 are secured, so that rescuers can more reliably rescue the passengers from vehicle 14.

Figure 8:
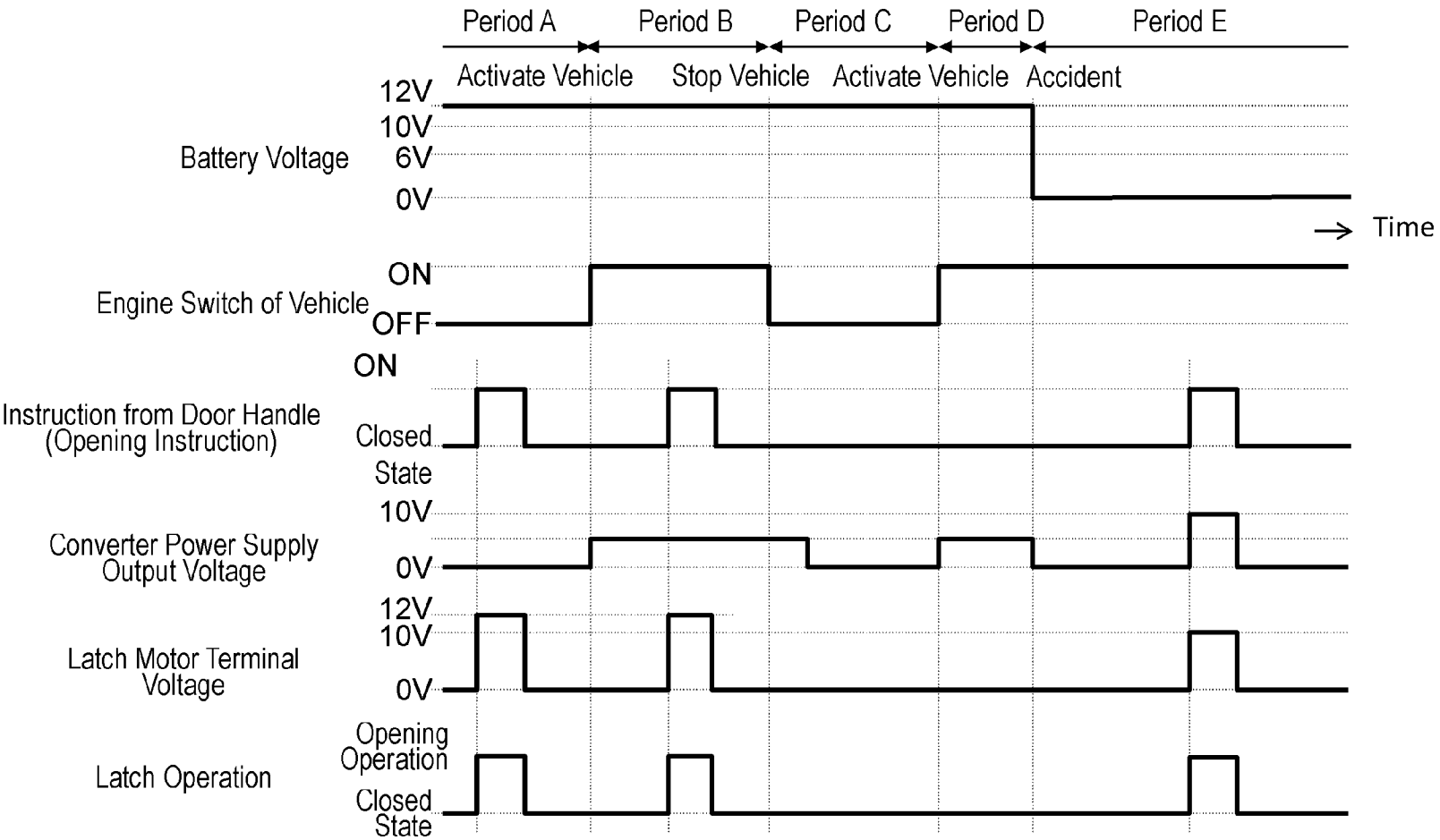
FIG. 8 is a time-sequence diagram of an operation state of a vehicle mounted with the door latching device according to the third exemplary embodiment, and a door latch.

Next, an operation of door latching device 8D will be described with reference to FIG. 8. FIG. 8 is a time-sequence diagram illustrating an operation state of the vehicle and door latching device 8D mounted on the vehicle. A curve of "Engine Switch Of Vehicle" indicates a change in a state of activation and stop instructions to vehicle 14 from engine switch 26, and a curve of "Converter Power Supply Output Voltage" indicates a fluctuation of an output voltage of converter power supply 110. The other curves are the same as those in FIG. 3.

Hereinafter, operations in period A, period B, period C, period D and period E will be described in this order. Here, activation of vehicle 14 indicates a timing at which engine switch 26 switches from OFF to ON, and stop of vehicle 14 indicates a timing at which engine switch 26 switches from ON to OFF.

First, period A will be described. Period A corresponds to a period before the user activates vehicle 14. A timing at which period A starts is not illustrated. However, this timing comes at a point of time at which vehicle 14 is stopped according to a correct procedure upon previous use.

Engine switch 26 is in an OFF state, and therefore vehicle 14 does not operate in period A. When the user pulls door handle 20 to get in or out of vehicle 14, controller 23 activates, detects a voltage of power supply line 22, and compares this voltage and the predetermined threshold. The predetermined threshold can be set to a value which does not go below as long as battery 16 is abnormal even when vehicle 14 has, for example, an idling stop function. In FIG. 8, the predetermined threshold is 6 V, for example. In period A, as the voltage of battery 16 is 12 V which is a normal voltage and is higher than the threshold, controller 23 determines that battery 16 is normal.

Hence, power of battery 16 is supplied to latch motor 12 through power supply line 22. At that time, controller 23 performs control to prevent converter power supply 110 from operating. As the voltage of battery 16 is supplied as it is to latch motor 12, a terminal voltage of battery 16 and a terminal voltage of latch motor 12 are both approximately 12 V. Thus, when the user operates door handle 20 in period A, latch 13 performs an opening operation.

Next, period B will be described. Period B corresponds to a period from a time at which the user activates vehicle 14 to a time at which the user stops vehicle 14 according to a correct procedure.

When engine switch 26 is switched from OFF to ON, vehicle 14 is activated. In response to activation of vehicle 14, controller 23 is activated. Controller 23 detects a voltage of power supply line 22 at all times while engine switch 26 is in an ON state, i.e., while engine switch 26 is at an ON position. Further, controller 23 compares the voltage of power supply line 22 and the threshold at all times. In period B, as the voltage of battery 16 is 12 V which is a normal voltage, and is higher than the threshold, controller 23 determines that battery 16 is normal.

Further, in response to activation of vehicle 14, converter power supply 110 is also activated. First, when charging circuit 27 of converter power supply 110 operates, electricity storage element 28 is fully charged or is charged to a nearly fully-charged state. At that time, discharging circuit 29 of converter power supply 110 discharges part of power stored in electricity storage element 28, and converter power supply 110 outputs low power. In this case, the voltage output from converter power supply 10 is lower than the voltage of battery 16 and is further lower than the threshold. Consequently, it is possible to prevent an output current from converter power supply 110 from making a reverse flow and entering power supply line 22. Further, the output current from converter power supply 110 becomes a weak current. That is, discharging circuit 29 operates by switching at a low on-duty.

The switching operation of a low on-duty continues to a beginning of period C described below. This continuing operation switches engine switch 26 to OFF, and therefore, during a period in which vehicle 14 is left, electricity storage element 28 is not fully changed. Particularly in a case where electricity storage element 28 is an electric double-layer capacitor, it is better that controller 23 or converter power supply 10 controls discharging circuit 29 in this way.

A case where the output voltage from converter power supply 110 is lower than the voltage of battery 16 has been described as an example. However, the output voltage of converter power supply 110 may be equivalent to the voltage of battery 16 or may be the threshold or greater and be less than the voltage of battery 16. In this case, a diode (not illustrated) may be connected to power supply line 22 in a manner that a cathode side of the diode is on the battery 16 side to prevent a reverse flow, and a reverse flow preventing function may be provided. In this case, when this diode operates in a forward direction, while the forward voltage drops more or less, power is not significantly lost.

Further, controller 23 may continuously or intermittently detect weak power of a weak current at a low voltage of discharging circuit 29. Consequently, it is possible to determine whether or not converter power supply 110 is in a state to be able to normally operate.

When the user pulls door handle 20 in period B as described above, power of battery 16 is supplied to latch motor 12 through power supply line 22 also in this period. Controller 23 performs control to cause converter power supply 110 to operate. Converter power supply 110 outputs a weak current at a lower voltage than 6 V which is the threshold. The voltage of battery 16 is supplied as it is to latch motor 12, and therefore a terminal voltage of battery 16 and a terminal voltage of latch motor 12 are both about 12 V. Thus, when the user operates door handle 20 in period B, latch 13 performs an opening operation.

Next, period C will be described. Period C corresponds to a period from a time at which the user stops the vehicle according to the correct procedure to a time at which the user activates vehicle 14 next time.

As engine switch 26 is in an OFF state, vehicle 14 does not operate. And there is no instruction from door handle 20, other components of door latching device 8D do not operate, either. As described above as to period B, converter power supply 110 continues a discharging operation of discharging circuit 29 in period B, and this operation is finished during period C. This continuation time may have a range from several minutes to several tens of minutes. Particularly in a case where electricity storage element 28 is an electric double-layer capacitor, controller 23 may estimate a capacity of electricity storage element 28 based on various constants of electricity storage element 28, and may set the discharging period of discharging circuit 29 based on this estimation result.

Electricity storage element 28 has been described using an electric double-layer capacitor. However, a secondary battery such as a lithium battery may be applied to electricity storage element 28. Then, operation characteristics of converter power supply 110 are determined according to characteristics of electricity storage element 28.

FIG. 8 does not illustrate an instruction from door handle 20, a terminal voltage of latch motor 12 and an operation of latch 13 in period C. However, similar to a case of period A, latch 13 performs an opening operation according to the instruction from door handle 20.

Next, period D will be described. Period D corresponds to a period from a time at which a user of vehicle 14 activates vehicle 14 to a time at which vehicle 14 gets involved in an accident.

When engine switch 26 is switched from OFF to ON, vehicle 14 is activated. Controller 23 is activated in response to activation of vehicle 14, and detects a voltage of power supply line 22 at all times while engine switch 26 is in an ON state, i.e., while engine switch 26 is at an ON position. Further, controller 23 compares the voltage of power supply line 22 and the threshold at all times. In period D, the voltage of battery 16 is 12 V which is a normal voltage and is higher than the threshold, and controller 23 determines that battery 16 is normal. These operations and an operation of converter power supply 110 are the same as the above-described operations in period B. For example, in period D, engine switch 26 is switched to ON, and then vehicle 14 is running or is stopping.

Next, period E will be described. Period E corresponds to a period on and after a time at which vehicle 14 gets involved in an accident. For example, although battery 16 and converter power supply 110 normally operate in period D described above, vehicle 14 gets involved in an emergency such as an accident and vehicle 14 loses power supply from battery 16. Period E corresponds to a state at or subsequent to a point of time at which vehicle 14 loses power supply from battery 16.

As vehicle 14 is operating and an instruction of engine switch 26 is an ON state, controller 23 which has been operating detects the voltage of battery 16. Further, when this voltage becomes lower than the threshold, controller 23 determines that vehicle 14 or battery 16 falls in an emergency. That is, even though vehicle 14 is normally activated and is in an operation state, the voltage of battery 16 suddenly lowers, and therefore controller 23 determines that vehicle 14 is abnormal.

Subsequently, controller 23 stops the operation of converter power supply 110 based on the above determination. The operation stop state of converter power supply 110 is a state where operations of charging circuit 27 and discharging circuit 29 stop and discharging circuit 29 can immediately restart according to the instruction from controller 23. Thus, the operations of charging circuit 27 and discharging circuit 29 stop, so that most of power stored in electricity storage element 28 is maintained in electricity storage element 28. Part of power stored in electricity storage element 28 is used to maintain the operation of controller 23 or maintain a controlling function of converter power supply 110. These operations and functions to be maintained require very small power. Consequently, it is possible to continue these operations and functions for a long period of time.

At a given timing after an abnormality such as an accident of vehicle 14 occurs, the passenger who is the user or a rescuer pulls door handle 21 or 20. Thus, controller 23 instructs converter power supply 110 to restart. Converter power supply 110 including electricity storage element 28 and discharging circuit 29 causes discharging circuit 29 to step up power stored in electricity storage element 28 based on the instruction from controller 23. Further, converter power supply 110 supplies power to latch motor 12 through latch motor connection switch 9. In this regard, the step-up operation of discharging circuit 29 is different from the operation in period B, and the stepped-up voltage needs to be at a level at which latch motor 12 can operate. This state corresponds to a state where power supply line 22 is cut. Hence, irrespective of whether or not a diode for a reverse flow prevention measure described above is connected, the stepped-up voltage is not applied to the input side of converter power supply 110. Discharging circuit 29 operates by switching at a high on-duty ratio compared to that of the operation in period B. Higher power is necessary to drive latch motor 12. Therefore, a current output from converter power supply 110 takes a value higher than a current in period B instead of a weak current. Consequently, it is not necessary to provide a function of selecting one power supply path of power supply line 22 and converter line 11B. Particularly, door latching device 8D can be made smaller and lighter and can be caused to operate in an unpredictable situation. Therefore, by reducing a device which has a switching function for selecting a power supply path, it is possible to enhance reliability of the operation of door latching device 8D.

Converter power supply 110 needs to operate only when door handle 20 or 21 is operated. That is, only when an output of power is required, discharging circuit 29 needs to step up and output power stored in electricity storage element 28. Consequently, door latching device 8D can perform an opening operation irrespective of an aftermath of an accident of vehicle 14, and performs a continuous opening operation or intermittently performs a repeated operation. That is, even in a situation that vehicle 14 gets involved in an accident, battery 16 falls in a critical situation and a great amount of time is required to rescue passengers from this accident, rescuers can repeatedly perform an opening operation of door latching device 8D from an outside of vehicle 14 not only once. Hence, door latching device 8D can enhance reliability related to a rescue.

It is preferable that a period in which latch motor connection switch 9 is closed is the same as a period in which door handle 20 is pulled to cause latch 13 to perform an opening operation. Alternatively, while the voltage of battery 16 suddenly lowers and goes below the threshold even though engine switch 26 is in an ON state, it is preferable that latch motor connection switch 9 is kept in a closed state. A period in which the voltage of battery 16 suddenly lowers and goes below the threshold even though engine switch 26 is in the ON state corresponds to an emergency. Therefore, by reducing an opening/closing operation as much as possible in this period, it is possible to enhance reliability of door latching device 8D.

Alternatively, a state where the voltage of battery 16 suddenly lowers and goes below the threshold even though engine switch 26 is in the ON state may continue even after a predetermined period of time passes. In this case, it is preferable that latch motor connection switch 9 is kept in the closed state after the predetermined period of time passes and in a period in which the voltage of battery 16 goes below the threshold. Consequently, door latching device 8D can accurately learn that a decrease in the voltage of battery 16 is not a temporary and accidental situation and is in an emergency, and operate. Further, by reducing an opening/closing operation as much as possible in this period, it is possible to enhance reliability of door latching device 8D.

As described above, the operation of door latching device 8D includes battery 16, interlock switch 25 and engine switch 26. Battery 16 is disposed at a certain position in vehicle 14, and is disposed outside door latching device 8D. Further, engine switch 26 is disposed at a certain position in vehicle 14, and is disposed outside door latching device 8D. In contrast, interlock switch 25 may be disposed inside or outside door latching device 8D.

Meanwhile, although interlock switch 25 is illustrated, a portion of interlock switch 25 may be short-circuited without disposing interlock switch 25. As a determination criterion based on which controller 23 of door latching device 8D determines a state of vehicle 14, the voltage of power supply line 22 corresponding to the voltage of battery 16 and the state of engine switch 26 are adopted. Interlock switch 25 is switched between ON and OFF by interlocking with ON and OFF of engine switch 26. However, door latching device 8D uses engine switch 26 as a reference. Therefore, the portion of interlock switch 25 may be short-circuited.

As described above, in the first to third exemplary embodiments, each of door latching device 8A to 8D has the electric opening operation function which can support a normal time and an emergency of vehicle 14. However, a mechanical opening operation function may be additionally disposed as a second emergency door latching function. Thus, two systems of door latching functions work upon an emergency. Door latching device 8 having the electric opening operation function is small and light. Consequently, even when the mechanical opening operation function is added, the weight of vehicle 14 does not significantly increase, thereby enhancing safety.

Further, the second emergency door latching function having the mechanical opening operation function does not need to be provided to all doors 18, and needs to be additionally provided to a frequently used door. Further, door latching devices 8A to 8D may be provided to back doors (not illustrated), a trunk door (not illustrated) and a fuel supply port (not illustrated). Consequently, the user can take out a baggage and tools upon an emergency or discharge an unnecessary fuel.

As described above, controller 23 is an independent single circuit or element which has various functions. Alternatively, controller 23 may be included in latch motor connection switch 9 or converter power supply 110, and the functions of controller 23 described above may be separately provided when necessary.

In addition, vehicle 14 having one of door latching devices 8A to 8D has been described above. However, door latching devices 8A and 8B are not limited to be mounted on vehicles and can be applied to movable bodies including transporting bodies such ships and play equipment.

INDUSTRIAL APPLICABILITY

As described above, according to the present invention, even when a battery voltage lowers, a latch can normally perform an opening operation. Consequently, it is possible to make a vehicle lighter by using only a door latching device which has an electric opening operation function for a normal time and an emergency, and improve fuel efficiency of the vehicle. Consequently, the door latching device is effectively used for various vehicles.

The invention claimed is:

1. A door latching device comprising:

a latch motor connection switch;

a converter line including a converter power supply having a charging circuit, a discharging circuit and an electricity storage element, and connected to an input side of the latch motor connection switch;

a latch motor connected to an output side of the latch motor connection switch, and driven when the latch motor connection switch is closed;

a latch caused to perform an opening operation when the latch motor is driven;

a power supply line connected to the input side of the latch motor connection switch and connected in parallel to the converter line; and a controller configured to detect a voltage value of the power supply line and configured to control the converter power supply, wherein, when the controller detects the voltage value of the power supply line is greater than or equal to a threshold, the controller is supplied with power from the power supply line and the charging circuit and the discharging circuit are operational, wherein the charging circuit charges the electricity storage element, when the controller detects the voltage value of the power supply line is less than the threshold and the controller determines that the power supply line is in an emergency state, the controller is supplied with power from the electricity storage element and the controller stops the operation of the charging circuit and the operation of the discharging circuit, and thereafter, when the controller receives an instruction for causing the latch to perform the opening operation, the converter power supply steps up the power charged in the electricity storage element and supplies the stepped up power to the latch motor, by the controller closing the latch motor connection switch and activating the discharging circuit.

2. The door latching device according to claim 1, wherein the converter power supply supplies power to the latch motor in a shorter period than a period in which the instruction for opening the latch is received.

3. The door latching device according to claim 1, wherein the controller is configured to detect a voltage value of the input side of the latch motor connection switch and to activate the converter power supply.

4. The door latching device according to claim 1, wherein the threshold is set a voltage value capable of driving the latch motor.

5. A movable body comprising:

a main body;

a door provided to the main body;

a door opening/closing instructor disposed at the door;

a battery provided to the main body;

an engine switch provided to the main body;

a latch motor connection switch;

a converter line including a converter power supply having a charging circuit, a discharging circuit and an electricity storage element, and configured to connect the battery and an input side of the latch motor connection switch;

a latch motor connected to an output side of the latch motor connection switch, and driven when the latch motor connection switch is closed;

a latch caused to perform an opening operation when the latch motor is driven;

a power supply line connected to the input side of the latch motor connection switch and connected in parallel to the converter line; and a controller configured to detect a voltage value of the power supply line and configured to control the converter power supply, wherein, when the controller detects the voltage value of the power supply line is greater than or equal to a threshold, the controller is supplied with power from the power supply line and the charging circuit and the discharging circuit are operational, wherein the charging circuit charges the electricity storage element, when the controller detects the voltage value of the power supply line is less than the threshold and the engine switch is in an ON state, the controller is supplied with power from the electricity storage element and the controller stops the operation of the charging circuit and the operation of the discharging circuit, and thereafter, when the controller receives an instruction for causing the latch to perform the opening operation, the converter power supply steps up the power charged in the electricity storage element and supplies the stepped up power to the latch motor, by the controller closing the latch motor connection switch and activating the discharging circuit.

6. A movable body comprising:

a main body;

a door provided to the main body;

a door opening/closing instructor disposed at the door;

a battery provided to the main body;

an engine switch provided to the main body;

a latch motor connection switch;

a converter line including a converter power supply which includes a charging circuit, a discharging circuit and an electricity storage element, and configured to connect to an input side of the latch motor connection switch;

a latch motor connected to an output side of the latch motor connection switch, and driven when the latch motor connection switch is closed;

a latch caused to perform an opening operation when the latch motor is driven;

a power supply line connected to the input side of the latch motor connection switch and connected in parallel to the converter line; and a controller configured to detect a voltage value of the power supply line and control the converter power supply, wherein, when the engine switch is turned to an ON state, the charging circuit starts charging the electricity storage element, when the controller detects the voltage value of the power supply is greater than or equal to a threshold in a state where the engine switch is in the ON state, the controller causes the converter power supply to continuously operate, wherein the charging circuit and the discharging circuit are operational and the charging circuit charges the electricity storage element, and the power supply line supplies power to the latch motor connection switch, and when the controller detects the voltage value of the power supply line is less than the threshold in a state where the engine switch is in the ON state, the controller is supplied with power from the electricity storage element and stops operating the converter power supply, then closes the latch motor connection switch based on an instruction from the door opening/closing instructor, and causes the converter power supply to shift its operation from a stop to an action, and the converter power supply steps up power charged to the converter power supply so as to supply the power to the latch motor.

7. A door latching device comprising:

a latch motor connection switch;

a converter line including a converter power supply connected to an input side of the latch motor connection switch;

a latch motor connected to an output side of the latch motor connection switch, and driven when the latch motor connection switch is closed;

a latch caused to perform an opening operation when the latch motor is driven;

a power supply line connected to the input side of the latch motor connection switch and connected in parallel to the converter line; and a controller configured to detect a voltage value of the power supply line and control the converter power supply, wherein, when the controller detects the voltage value of the power supply line is greater than a threshold, a power that drives the latch motor is supplied to the latch motor via the power supply line, when the controller detects the voltage value of the power supply line is less than the threshold and the controller determines that the power supply line is in an emergency state, the controller controls the converter power supply and the power that drives the latch motor is supplied to the latch motor via the converter line to step up the voltage value of the power by the converter power supply, and the threshold is set to a voltage value greater than a minimum value capable of driving the latch motor.

8. The door latching device according to claim 7, wherein the converter power supply includes an electricity storage element, which is charged when the controller detects the voltage value of the power supply line is greater than a threshold, and which supplies the power charged in the electricity storage element to the controller when the controller detects the voltage value of the power supply line is less than the threshold.

9. The door latching device according to claim 8, wherein after the electricity storage element supplies the power to the controller and when the controller receives an instruction for causing the latch to perform the opening operation, the converter power supply steps up the power charged in the electricity storage element and supplies the power stepped up by the converter power supply to the latch motor.

10. The door latching device according to claim 7, wherein the threshold is within a range from 6 V to 10 V.

* * * * *